United States Patent [19]

Noschese

[11] 4,060,030

[45] Nov. 29, 1977

[54] STENCIL SHEET HOLDER

[76] Inventor: Fred J. Noschese, 74 Gavin St., Yonkers, N.Y. 10701

[21] Appl. No.: 599,606

[22] Filed: July 28, 1975

[51] Int. Cl.[2] ..... B41F 15/36

[52] U.S. Cl. ..... 101/127.1;

[58] Field of Search ..... 38/102.4, 102.5, 102.91; 282/29 R; 281/45 101/127;127.1;128.1;128.2;128.4;113;131;415.1

[56] References Cited

U.S. PATENT DOCUMENTS

| | | | |
|---|---|---|---|
| 746,950 | 12/1903 | Gestetner | 101/128.2 X |
| 2,061,525 | 11/1936 | Storck | 101/415.1 X |
| 2,195,556 | 4/1940 | Beattie et al. | 101/128.2 X |
| 3,486,770 | 12/1969 | Anderson | 281/45 |

FOREIGN PATENT DOCUMENTS

| | | | |
|---|---|---|---|
| 22,930 | 12/1901 | Switzerland | 101/131 |

*Primary Examiner*—Edgar S. Burr
*Assistant Examiner*—R. E. Suter
*Attorney, Agent, or Firm*—Bernard Franzblau

[57] ABSTRACT

A new and improved stencil-sheet holder includes a frame adapted to define a central open area over which a stencil-sheet is mounted so that the major part of its surface is suspended in air with sufficient tension to prevent the formation of wrinkles in the stencil-sheet. A novel support structure adjustable in the longitudinal direction is provided so that different size stencil-sheets can be readily accommodated in the apparatus. Removable support pins make it possible to support different styles of stencil-sheets.

8 Claims, 2 Drawing Figures

STENCIL SHEET HOLDER

BACKGROUND OF THE INVENTION

This invention relates to a new and improved stencil-sheet holder adapted to facilitate making corrections on a stencil-sheet. More particularly, the invention relates to a novel apparatus wherein the stencil-sheet is mounted on an open frame for correction purposes, said apparatus being adjustable for different size stencil-sheets and including means for holding the stencil-sheet under tension.

In the art of fabricating stencil-sheets, the problem arises of correcting errors or removing dirt from the completed stencil-sheet before it is to be used in a duplicating machine for the multiple reproduction of the printed or other matter inpressed thereon. In order to make said corrections, it is necessary to freely suspend the stencil-sheet out of contact with other surfaces except for support provided at the top and bottom edges. The general practice is to manually hold the uncorrected stencil-sheet in front of a strong light and then apply a suitable correction fluid to remove any errors or dirt appearing on the stencil-sheet. This process is relatively laborious, tedious and time consuming since it is difficult to hold the stencil-sheet in position with forming wrinkles therein and to simultaneously apply the correction fluid to the stencil-sheet to correct any errors or dirt thereon.

SUMMARY OF THE INVENTION

It is therefore an object of the invention to provide a stencil-sheet holder that will facilitate and also reduce the time required to make corrections on a "preprinted" electronic stencil-sheet.

Another object of the invention is to provide a novel stencil-sheet holder having means for supporting the stencil-sheet so that, except for the top and bottom ends, it is essentially suspended in air with sufficient tension to prevent the formation of any wrinkles therein.

A further object of the invention is to provide a novel stencil-sheet holder that is adjustable in size so as to readily accomodate different size stencil-sheets.

Another object of the invention is to provide a novel support apparatus for a stencil-sheet, which apparatus is of relatively simple construction and is capable of relatively inexpensive manufacture, and is furthermore simple to employ and operate by unskilled persons.

The foregoing and other objects and advantages are achieved by providing a stencil-sheet holder having a frame that defines a central open area over which a stencil-sheet is to be held "suspended in air". At one end of the frame I provide an improved clamping device utilizing complementary mating surfaces. At the opposite end is a novel support structure that is adjustable in the longitudinal direction and includes means for applying tension to a stencil-sheet to hold same in a taut condition over said open area, and without the formation of any wrinkles therein. A further feature is the provision of removable support pins whose location can be altered to suit different types or sytles of stencil-sheets.

BRIEF DESCRIPTION OF THE DRAWING

The foregoing and other objects, advantages, and unique aspects of the invention will be better understood and appreciated upon consideration of the following detailed description thereof and taken in conjuction with the accompanying drawings in which.

Figure 1:
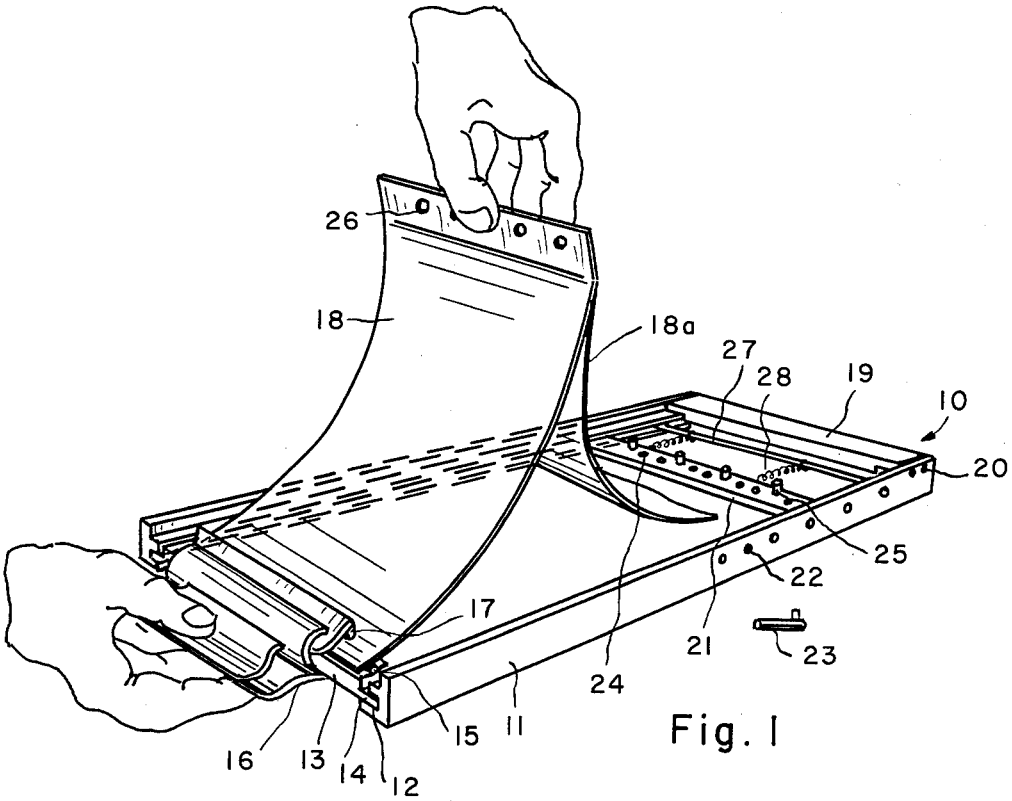
FIG. 1 is a perspective view of the novel stencil-sheet holder of my invention showing a stencil-sheet in the process of being inserted into its holder.

Referring now to the drawings in detail, there is shown my novel stencil-sheet holder comprising a generally rectangular shaped, rigid, open support frame member 10 consisting of a pair of parallel longitudinally extending side walls 11 having U-shaped channels 12 formed in the confronting surfaces thereof. A transverse bar 13 has complementary shaped lip members 14 that fit into the channels 12 of the side walls 11. The bar 13 may be fixed in position by means of screws (not shown) or any other suitable fastening device. Alternatively, the bar 13 may be adjustable in the longitudinal direction to accomodate stencil-sheets of different lengths. In this case, one suitable method for adjusting the longitudinal position of the bar 13 and for securing same in place could consist of longitudinal slots (not shown) in the bottom surfaces of side walls 11 along with screws (not shown) adapted to be screwed into threaded holes (also not shown) in the lip members 14 via said slots. The transverse bar 13 also includes a semi-circular groove 15 formed in its top surface. A spring-biased hinged holding clamp 16 has a complementary-shaped ridge 17 thereon which is adapted to mate with the groove 15. In operation, a stencil-sheet 18 is inserted in position with one end over the groove 15 and is clamped in place by means of the spring-biased jaws of the clamp which force the ridge 17 against the stencil-sheet and into the groove 15. Although the precise form of holding clamp is not critical to the overall practice of the invention, the use of complementary shaped members 17 and 15 has been found to provide very satisfactory wrinkle-free support of the stencil-sheet and is the preferred means for securing said one end of the stencil-sheet in the holder. It is of course true that other devices for securing one end of the stencil-sheet in position will readily suggest themselves to persons skilled in the art and come within the overall scope of my invention. However, the particular structure shown in the drawings can be recommended because of its simplicity of construction and satisfactory performance.

The top end of the frame member 10 consists of a transverse bar 19 secured to the side walls 11 be means of pins 20, or other suitable fasteners such as screws or the like, extending through the outer surfaces of the side walls. The bar 19 is notched at each end to mate with the top wall of the U-shaped channel member 12.

A cross-bar support means consisting of a longitudinally positionable tension bar 21 fits within the grooves in the channel member 12 and is supported therein with sufficient clearance to allow it to slide freely in the grooves.

The tension bar 21 has a plurality of circular recesses 24 formed in its top surface which are adapted to support stencil pins 25. The locations of the pins in the tension bar recesses can be easily changed to accomodate different arrangements of the holes 26 in the stencil-sheet, thereby providing a very flexible holding apparatus.

A cylindrical rod 27 is supported in the side walls 11 of the support frame. The tension bar 21 is secured to the rod 27 by means of a pair of coiled springs 28. The side walls contain a number of longitudinally spaced holes 22 for supporting the cylindrical rod 27 and by means of which the position of the rod and tension bar can be adjusted in the longitudinal direction to support different size stencil sheets. The ends of the cylindrical rod may be hollow so as to house a conventional spring-loaded pin 23 that is urged into the holes 22 in the side walls whereby the rod 27 can be longitudinally adjusted and secured in any one of the positions represented by the aforesaid holes. By means of the foregoing structure the apparatus can readily accomodate different size stencil-sheets. Other means for longitudinal adjustment of the rod and tension bar will of course suggest themselves to persons skilled in the art.

The tension bar and rod are located longitudinally in accordance with the length of the stencil sheet to be corrected so that the tension bar will apply a predetermined amount of tension to the springs, and thus on the stencil sheet secured to the tension bar. The amount of tension applied is just enough to take up any slack in the stencil sheet and thus prevent the formation of wrinkles therein. The longitudinal adjustment feature makes it possible to maintain a uniform tension on the bar 21 and the stencil sheet for all size stencil sheets.

A flat hand rest member 29 with notches at either end is also provided. The member 29 is supported on the top walls of the U-shaped channel 12. The hand rest is slidable along the frame to provide ease of operation and is not secured thereto so that it can be easily removed to facilitate the insertion and removeal of a stencil-sheet from the holder.

Figure 2:
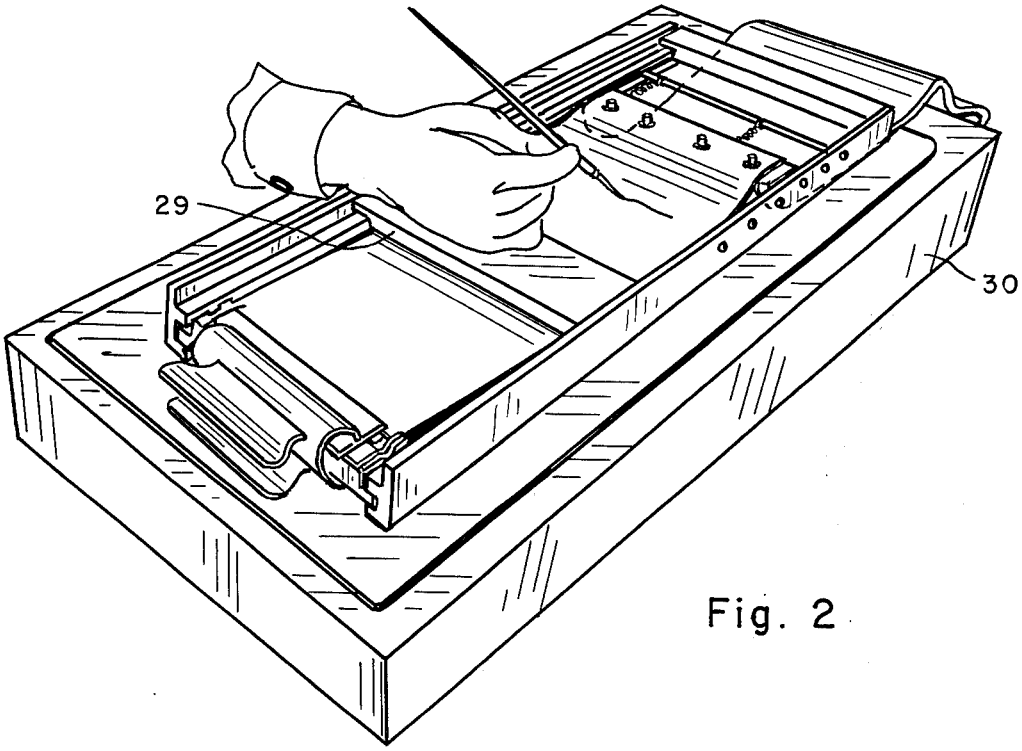
FIG. 2 is a perspective view of the invention with the stencil-sheet in place and ready for use.

In operation, the bar 27 is positioned in one of the holes 22 in accordance with the size of the particular stencil sheet it is desired to correct. The stencil-sheet 18 is then secured in place at one end by means of the clamp 16. The backing sheet **18*a* is now passed under the tension bar 21 and out beyond the top end of the frame (see FIG. 2). The top end of the stencil-sheet is secured to the tension bar by mating the holes 26 with the pins 25. The next step is to lay the frame 10 with the stencil-sheet mounted thereon onto the top surface of a light table 30**. The light table is a conventional device and provides a source of light (not shown) for illuminating the stencil-sheet so that an operator can readily view a completed stencil in order to clean up any marks or dirt or to make any necessary corrections of the matter printed thereon. The light table has a frosted or tinted glass surface so as to diffuse light and thereby provide a very satisfactory light pattern especially adapted for the desired purpose. The lower leg of the U-shaped channel separates the stencil-sheet from contact with the glass surface of the light table. The hand rest is finally laid in place and adjusted to a comfortable position so that a person using the apparatus can readily make the required corrections on the stencil-sheet with a minimum of time and fatigue.

Although the invention has been described and illustrated with reference to a specific embodiment thereof, it will be understood that various modifications may be made and other embodiments may be resorted to without departing from the true spirit and scope of the invention. Therefore, the form of the invention set out above should be considered as illustrative only and not as limiting the scope of the appended claims.

I claim:

1. A stencil-sheet holder assembly comprising, a rigid frame having peripheral leg members that define a central open area, said peripheral leg members including two rigid non-flexible longitudinally extending parallel leg members, clamping means located near one end of said frame for securing one end of a stencil-sheet to said one end of the frame, a cross-bar support means movably mounted to the other end of the frame and having means for securing the stencil-sheet thereto, means for longitudinally adjusting the position of the cross-bar support means, and spring tensioning means secured to the cross-bar support means and the position adjusting means so as to urge the cross-bar support means in the direction of said other end of the frame thereby to support a stencil-sheet under tension over the central open area of the frame.

2. A stencil-sheet holder assembly as claimed in claim 1 wherein said longitudinal adjusting means comprises a longitudinally adjustable rod securable to the frame at a plurality of points near said other end of the frame, and wherein said spring tensioning means is secured to the cross-bar support means and the adjustable rod.

3. A stencil-sheet holder assembly as claimed in claim 2 wherein the two parallel longitudinally extending leg members have confronting grooves formed therein and the cross-bar support means is mounted to slide within said grooves.

4. A stencil-sheet holder assembly as claimed in claim 1 wherein said cross-bar support means includes a plurality of recesses formed in the cross-bar for holding pin-shaped members which in turn are adapted to mate with holes in a stencil-sheet, said pin-shaped members being held in the recesses with sufficient clearance to allow easy removal thereof.

5. A stencil-sheet holder assembly as claimed in claim 1 wherein said clamping means comprises a first transverse member with a semi-circular groove formed therein, a second transverse member having a complementary shaped ridge formed therein, and hinged means for spring-biassing the second transverse member into engagement with the groove in the first transverse member.

6. A stencil-sheet holder assembly as claimed in claim 1 further comprising a transverse member slidable along the frame in the longitudinal direction to provide a hand rest for said assembly.

7. A stencil-sheet holder assembly as claimed in claim 1 wherein said rigid frame is rectangular shaped and includes two further peripheral leg members parallel to one another and extending orthogonal to said two rigid longitudinally extending leg members, said two further peripheral leg members being made of a rigid non-flexible material so as to form with said two longitudinally extending leg members an integral rectangular frame and said two parallel longitudinally extending leg members have confronting u-shaped grooves formed therein for supporting the cross-bar support means and a part of said clamping means.

8. A stencil-sheet holder assembly as claimed in claim 1 wherein said rigid frame has a rectangular shape and further includes twofurther rigid non-flexible leg members parallel to one another and perpendicular to said two rigid longitudinally extending leg members so as to form said central open work area over which open area a major part of the surface of the stencil-sheet may be suspended in air without making contact with any underlying support surface.

* * * * *